US008546260B2

(12) United States Patent
Hsu et al.

(10) Patent No.: US 8,546,260 B2
(45) Date of Patent: Oct. 1, 2013

(54) FABRIC CONTAINING NON-CRIMPED FIBERS AND METHODS OF MANUFACTURE

(75) Inventors: Oscar K. Hsu, Chelmsford, MA (US); Paul Lefevre, Topsfield, MA (US)

(73) Assignee: Innopad, Inc., Wilmington, MA (US)

( * ) Notice: Subject to any disclaimer, the term of this patent is extended or adjusted under 35 U.S.C. 154(b) by 190 days.

(21) Appl. No.: 13/062,312

(22) PCT Filed: Sep. 3, 2009

(86) PCT No.: PCT/US2009/055896

§ 371 (c)(1), (2), (4) Date: Mar. 4, 2011

(87) PCT Pub. No.: WO2010/028154

PCT Pub. Date: Mar. 11, 2010

(65) Prior Publication Data

US 2011/0171831 A1 Jul. 14, 2011

Related U.S. Application Data

(60) Provisional application No. 61/094,345, filed on Sep. 4, 2008.

(51) Int. Cl.
*H01L 21/302* (2006.01)
*H01L 21/461* (2006.01)

(52) U.S. Cl.
USPC ..... 438/689; 438/690; 438/691; 438/692; 51/307; 51/308

(58) Field of Classification Search
None
See application file for complete search history.

(56) References Cited

U.S. PATENT DOCUMENTS

| | | | | |
|---|---|---|---|---|
| 2004/0072507 | A1 | 4/2004 | Hsu et al. | |
| 2005/0060829 | A1 * | 3/2005 | Silvers et al. | 15/230 |
| 2006/0035088 | A1 | 2/2006 | Takano et al. | |
| 2006/0183392 | A1 * | 8/2006 | Silvers et al. | 442/308 |
| 2006/0252334 | A1 * | 11/2006 | LoFaro et al. | 442/400 |

OTHER PUBLICATIONS

International Search Report from corresponding PCT Application No. PCT/US2009/55896 dated Oct. 22, 2009.

* cited by examiner

*Primary Examiner* — Duy Deo
(74) *Attorney, Agent, or Firm* — Grossman, Tucker, Perreault & Pfleger, PLLC

(57) ABSTRACT

A chemical-mechanical planarization pad for semiconductor manufacturing is provided. The pad comprises synthetic fibers that are non-crimped fibers which are present in an amount of 1.0% by weight to 98.0% by weight in the mat and wherein the non-crimped fibers have a length of 0.1 cm to 127 cm and a diameter of 1.0 to 1000 micrometers.

22 Claims, 4 Drawing Sheets

FABRIC CONTAINING NON-CRIMPED FIBERS AND METHODS OF MANUFACTURE

CROSS REFERENCE TO RELATED APPLICATIONS

This application is a National Stage Completion of PCT/US2009/055896 filed Sep. 3, 2009 which claims the benefit of priority under 35 U.S.C. §119(e) to U.S. provisional application No. 61/094,345 filed Sep. 4, 2008 which are incorporated by reference in their entirety.

FIELD OF INVENTION

The present disclosure relates to a fabric, such as a nonwoven, woven or knitted fabric, that may contain non-crimped fibers and in particular, chemical-mechanical planarization pads made from such fabrics.

BACKGROUND

A nonwoven fabric may be understood as a textile fabric that is not made by the conventional weaving or knitting process. A nonwoven fabric may be made by first laying down a mat comprising of a plurality of continuous filaments or non-continuous fibers, followed by mechanical, thermal, chemical or combinations thereof to bind the individual filaments or fibers together into the said nonwoven fabric. The fiber commonly used in the nonwoven industry may include polyester, polyolefin, polyamide, polyvinyl alcohol, polyacrylate, cellulosic, rayon, polyurethane, polysulfone, polyphenyl sulfide, etc. Typical fiber lengths may range from 0.05 inches and higher, and more commonly from 0.25 inches to 3 inches, and typical fiber diameters may range from 0.1 micrometers and higher, and more commonly from 5 to 50 micrometers.

Conventional nonwoven manufacturing may consist of taking fibers from tightly packed bales, separating large fiber bundles in a process called bale opening, mixing different fiber types (if two or more fiber types are used), followed by a process of coarse and fine opening and blending, before laying down the fiber mat by commonly used methods such as the dry-laid or air-laid processes. Said common methods for laying down a mat comprising of a plurality of fibers may include (1) dry-laid, where the individual fibers may be separated from one another by combing within a set gap between a pair of toothed plates or rolls then laid down as a fiber mat onto a conveyor, and (2) air-laid, where the individual fibers may be separated from one another and laid down as a fiber mat by means of a controlled air current rather than toothed plates or rolls. Common methods for binding the laid down fiber mat may include (1) mechanical techniques such as stitch-bonding, or needle-punching the fiber mat to effect fiber to fiber entanglement, (2) thermal techniques such as heating the fiber mat to its softening or melting temperature and applying pressure to effect fiber to fiber adhesion, and (3) chemical technique such as adding solvent, adhesive or chemical bonding agent to the fiber mat to effect fiber to fiber adhesion.

Fibers that are made for dry-laid and air-laid methods may typically be crimped, i.e. the individual fibers are not straight but are configured in a zig-zag or loopy fashion, with each fiber containing one or more, and more commonly five to thirty individual crimps, i.e. zig-zags or loops. Such zig-zags or loops may be imparted on individual fibers in a process called crimping, by applying dry heat or steam to heat set the fibers pressed into a zig-zag or loopy configuration in a crimp box to effect the required extent of crimp. Such crimping may be necessary for fibers to grasp onto each other during the laid down process. Fibers without said crimp, i.e. straight fibers, may not possess the necessary frictional or cohesive strength required for the laying down process, resulting in constant and random breakages and rendering it difficult to proceed with the subsequent binding process.

SUMMARY

In a first exemplary embodiment, the present disclosure relates to a polishing pad for chemical-mechanical planarization of semiconductors comprising a fabric comprising a mat containing synthetic fibers, wherein the fibers are non-crimped fibers present in an amount of 1.0% by weight to 98.0% by weight in the mat and wherein the non-crimped fibers have a length of 0.1 cm to 127 cm and a diameter of 1.0 to 1000 micrometers.

In another exemplary embodiment, the present disclosure relates to a polishing pad for chemical-mechanical planarization of semiconductors comprising a fabric comprising a mat containing synthetic fibers, wherein the fibers are non-crimped fibers present in an amount of 1.0% by weight to 98.0% by weight in the mat and wherein the non-crimped fibers have a length of 0.1 cm to 127 cm and a diameter of 1.0 to 1000 micrometers, and wherein the non-crimped fibers are at least partially soluble in an aqueous solution.

In a still further exemplary embodiment, the present disclosure relates to a method for chemical-mechanical planarization of semiconductors comprising supplying a mat containing synthetic fibers, wherein the fibers are non-crimped fibers and are present in an amount of 1.0% by weight to 98.0% by weight in the mat and wherein the non-crimped fibers have a length of 0.1 cm to 127 cm and a diameter of 1.0 to 1000 micrometers, and polishing a semiconductor with said mat.

BRIEF DESCRIPTION OF THE DRAWINGS

The above and other objects, features and advantages of the invention will be apparent in the following detailed description thereof when read in conjunction with the appended drawing wherein the same reference numerals denote the same or similar parts on the figure.

DETAILED DESCRIPTION

Figure 1:
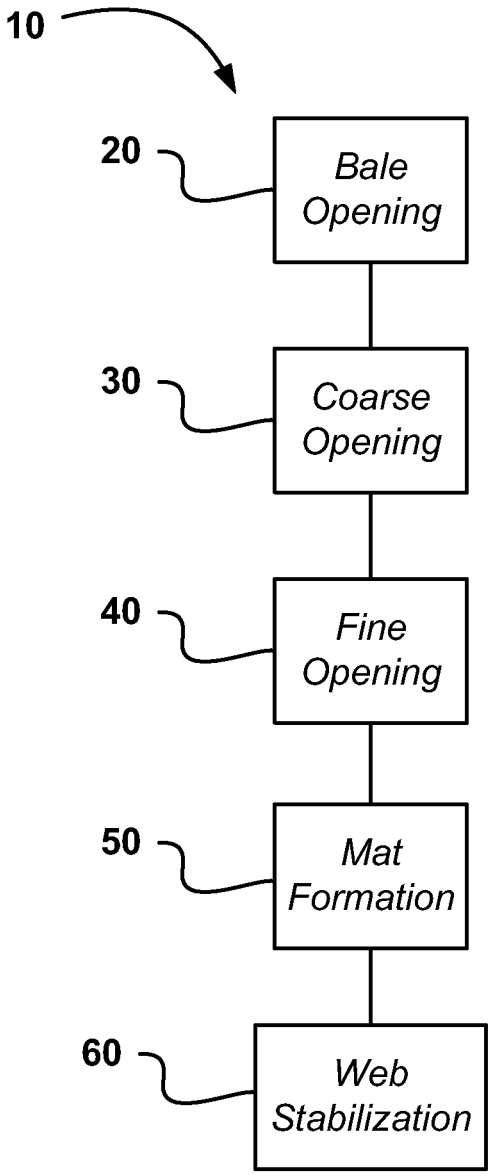
FIG. 1 is a flow chart illustrating one method of polishing pad preparation herein.

It may be appreciated that the present disclosure is not limited in its application to the details of construction and the arrangement of components set forth in the following description or illustrated in the drawings. The embodiments herein may be capable of other embodiments and of being practiced or of being carried out in various ways. Also, it may be appreciated that the phraseology and terminology used herein is for the purpose of description and should not be regarded as limiting.

The present disclosure recognizes that in certain applications it may be necessary and even desirable to use straight, or non-crimped, fibers in the processes for forming nonwoven fabrics. Such applications include, but are not limited to nonwoven fabrics used for making chemical-mechanical planarization pads for semiconductor manufacturing where soluble fibers made from polyvinyl alcohol and/or polyacrylate may be used, and where the solubility of such fibers may be reduced or destroyed if they are subjected to the dry or steam heat of the crimping process. Chemical-mechanical planarization or polishing may be understood herein as the polishing of a semiconductor which may typically take place in the presence of a liquid slurry. The pad may therefore be positioned within a polishing tool, which is configured to apply the pad to a given semiconductor surface in the presence of a slurry, which slurry is typically aqueous based. Accordingly, upon application of the pad to the semiconductor surface, with a regulated amount of pressure, via the polishing tool, polishing of the semiconductor surface may occur.

In such context, one may therefore provide synthetic fibers having relatively high tensile strength and stiffness but low extensibility characteristics for dimensional stability under stress, wherein such synthetic fibers may benefit from the use of straight, non-crimped fibers. Furthermore, in such context one may provide a pad with synthetic fibers having relatively controlled pore size and distribution, wherein such fibers may benefit from the use of non-crimped fibers because the presence of the essentially three-dimensional zig-zag or loopy crimps may make it difficult to lay down, e.g., a nonwoven fabric with controlled pore size and distribution.

As alluded to above, dry-laid or air-laid processes may utilize a relatively high degree of crimped fibers. Crimped fibers may be understood as those fibers that may have a desired shape imparted therein, such as a succession of waves or curls in the fiber strand, induced by heat, mechanical forces and/or even chemically. Crimped fibers may therefore be considered to include a degree of deviation from linearity in a non-straight fiber. Crimp in a fiber may therefore take the form of a helical crimp and/or a planar crimp (zig-zag configuration). Crimping procedures that are commonly used typically rely upon the thermoplastic properties of the fiber and the setting of fiber crimp may be caused by structural changes in the fiber at the molecular level through a process of, e.g., crystallization and crystalline reorganization. More specifically, crimping procedures may include what is known as false twist texturing (multi-filament yarn is highly twisted, thermally set at a temperature higher than the glass transition temperature, cooled, untwisted to stabilize the crimp); stuffer box texturing (yarn is fed through a nip into a stuffer box and folded against the box pressure); impact texturing (yarn is plasticized and subsequently impacted onto a cooling surface); edge crimping (heated yarn is passed over dulled knife-edge causing crystallite rupture at an inside bend); gear crimping (heated yarn is passed between gear wheels and crimped shape is set); knit-deknit (yarn is knitted into fabric that is thermally set and unraveled); air-jet texturing (yarn is over fed through a turbulent air stream inside a jet assembly so that entangled loops are formed in filaments); bicomponent crimping (yarn is composed of bicomponent fibers in asymmetric cross-section and subject to shear relaxation with differential shrinkage).

Crimped fibers may commonly be required in the manufacturing of nonwoven fabrics, providing the necessary frictional or cohesive strength to the fiber mass during the fiber laying down process. In addition, nonwoven fabrics made with crimped fibers may be considered desirable for applications such as textile garments which may require a degree of loftiness, suppleness and drape-ability.

However, the process of crimping fibers may reduce or damage the ability of some nonwoven fabrics to be manufactured for industrial applications as mentioned earlier. In addition, the crimping processes may impart thermal or mechanical stresses on certain fibers, which may cause the fibers to break and/or the resulting nonwoven fabric to exhibit lower strength characteristics.

The present disclosure relates to producing fabric with synthetic fibers (fibers that are produced via some synthetic procedure of polymerization and/or post-polymerization chemical process) that may comprise up to 98% by weight of a plurality of non-crimped fibers, i.e., fibers that are not crimped, and which have not been subjected to a fiber crimping operation and/or induced crimping during fiber manufacture (e.g. during extrusion formation). The non-crimped fibers may be soluble in aqueous or water containing media and such solubility may be reduced or destroyed if the soluble fibers are subjected to the dry or steam heat of the crimping process. The fabrics, formed with the non-crimped fibers, may then be formed into chemical-mechanical planarization pads.

As noted above, the fabric may be a nonwoven fabric, or a woven fabric, or a knitted fabric, wherein the fabric may be produced by forming a mat of non-continuous fibers. Reference to non-continuous fibers herein may be understood as fibers that have a length of less than or equal to 4.0 cm, or in the range of 0.1 cm to 4.0 cm, in 0.1 cm increments. The mat may be formed by a number of processes such as dry-laying and/or air-laying, wherein fibers may be separated from a bale, formed into a mat, and distributed by an air stream or aligned by carding either at given angles or in a random configuration.

An optional, removable stabilizer fabric may be used as a carrier for the mat. The stabilizer may include spunbond, melt blown or other fabric. In addition, the stabilizer may be formed of a synthetic or natural fiber, including polyester, polyolefins, nylon, etc. Once bonded, the optional stabilizer may be removed from the fabric.

The nonwoven fabric may be bonded by mechanical, thermal, chemical processes or combinations thereof. Examples of mechanical processes may include stitch-bonding, needle-punching, spunlacing or hydroentangling, etc. Thermal bonding techniques may include hot calendering, through air bonding, infrared bonding or ultrasonic welding, etc. Chemical techniques may include the use of solvents, adhesives or chemical bonding agents, etc. In addition, polymer resins may also be used in the spunbonding and melt-blowing techniques to form a nonwoven fabric, whereby the resin may be melted and extruded through nozzles or spinnerets onto a conveyer belt under an air current to control fiber lay down. In these instances, the laid down fibers may be, as alluded to above, continuous (lengths greater than 4.0 cm) or non-continuous (lengths less than or equal to 4.0 cm).

As noted above, the synthetic fibers may include up to 98.0% by weight of a non-crimped fiber, including all values and increments in the range of 1.0% to 98.0% by weight of non-crimped fiber, in 1.0% by weight increments. Preferably, the weight of non-crimped fiber may be greater than or equal to 50.0% by weight, thereby providing a preferably range of non-crimped fibers at a level of 50.0% to 98.0% by weight. More preferably, the level of non-crimped fibers may be present at a level of 50.0% by weight to 90.0% by weight.

Such fiber may include, for example, polyester, polyolefin, polyamide, rayon, polyurethane, polysulfone, and water soluble or swellable polyacrylate, polyvinyl alcohol, alginate and pectin, as well as fibers derived of complex carbohydrates, starch or cellulosics, as well as combinations thereof. Furthermore, fibers such as polyacrylate or polyvinyl alcohol may be non-crosslinked or incompletely crosslinked. For example, less than 50% of the available crosslinking moieties (reactive or functional groups) on a polymer chain or backbone may be crosslinked, including all values in the range of 0% to 50%, such as 0% to 10%. In general, for polishing pad applications, the non-crimped fiber lengths may ultimately range from 0.1 cm to 127 cm including all values and increments therein, and fiber diameters may range from 1.0 to 1000 micrometers (μm) including all values and increments therein. For example, the fiber diameter of the non-crimped fiber may be in the range of 5.0 to 50 micrometers.

At least a portion of or all of the non-crimped fibers may be at least partially (less than 100% by weight) or nearly completely soluble (95% to 100% by weight) in aqueous solution (a liquid containing water). In addition, fibers of varying solubility may be added to the fabric. For example, a first non-crimped fiber having a first degree of solubility ($S_1$) may be added to a second non-crimped fiber having a second degree of solubility ($S_2$), and wherein $S_1$ has a different value than $S_2$. More than two fibers may be blended as well, such as in a case wherein fibers having three degrees of solubility may be selected, each having a different degree of solubility. Accordingly, three fibers may be present, which may be non-crimped, each having a degree of solubility for a selected aqueous solution (or slurry) wherein $S_1$ and $S_2$ and $S_3$ for the three fibers are all different in relative values.

Reference to a varying degree of solubility in an aqueous solution may be understood as that situation where, for a given aqueous solution, the time for dissolution of the fiber is evaluated. Accordingly, a fiber with a degree of solubility that is greater than a corresponding fiber indicates that for a given aqueous solution, the fiber with the greater degree of solubility will dissolve relatively sooner than the fiber with the lower degree of solubility. As noted above, reference to an aqueous solution may be understood as a solution containing water, wherein the water is present at a level of at least 5.0% by weight.

The remainder of the fiber, from 2 to 98% by weight, including all values and increments therein, may include a crimped fiber. The crimped fiber may include polyester, polyolefin, polyamide, cellulosic, rayon, polyurethane, polysulfone, etc. Crimped fiber lengths 0.1 cm to 127 cm including all values and increments therein, and fiber diameters may range from 1 to 1000 micrometers (μm) including all values and increments therein. It may therefore be appreciated that for a level of crimped soluble fibers in the range of 50% by weight to 90% by weight, the level of crimped fiber may be in the corresponding range of 50% by weight to 10% by weight.

In one example, the crimped fiber portion itself may be soluble or insoluble in an aqueous solution. In another example, the crimped fiber may be a bi-component fiber, i.e., a fiber that may include at least two components, such as two different polymer components defined by two different repeating units, which may exhibit different softening points (e.g. glass transition temperatures or Tg) or melting temperatures (Tm). For example, the two different polymer components may comprise a polyester and a polyamide, or a polyester and a polyolefin, etc. In addition, the crimped fiber may include a binder fiber, such as a fiber that may exhibit a softening point or melting temperature that is less than that of, for example, the non-crimped fiber. The binder fiber and/or bicomponent fiber may be used as an adherent or fastening agent in the fiber mat when softened or melted under elevated temperature.

The fiber may be formed into a mat and eventually into a fabric, as illustrated in the example depicted in the flow chart of FIG. 1. The process 10 may begin by bale opening, i.e., picking or removing fibers or tufts of fibers from a bale 20. The tufts of fibers may then be coarsely opened or at least partially separated 30 and then finely opened 40. A web or mat may be formed 50 by either dry-laid carding, garneting or air-laying. The web may be bonded or otherwise stabilized 60, using mechanical, thermal or chemical techniques for forming a fabric.

The non-crimped fiber may be processed separately from the remainder of the fiber, i.e., crimped fiber, prior to forming a mat, which may include both fibers. For example, bale opening and/or coarse and fine opening. The fibers may then be combined or blended together and may proceed through further fiber opening. After blending, a mat of the fibers may be formed by either a dry-laying (a process for forming a web of dry fibers by use of carding equipment) or an air-laying process (the formation of webs utilizing a stream of air).

The fabric mats may then be bonded via a number of bonding processes, including mechanical, thermal or chemical processes. For example, the mat may be needled or stitched. In another example, the mat may be bonded using binder fibers or bicomponent fibers as a portion of the crimped fibers or continuous filaments.

EXAMPLES

One non-limiting example of this invention uses 90% by weight of a 10 dtex soluble polyacrylate fiber such as a non-crimped Oasis™ polyacrylate fiber from Technical Absorbent Ltd and 10% by weight of a 1.7 dtex soluble crimped Kuralon™ polyvinyl alcohol fiber from Kuraray. The crimped Kuralon fibers are first separated evenly by coarse then fine opening operations without the non-crimped Oasis fiber. The Oasis fiber, on the other hand, may be subjected to a humidity stabilization process whereby the fiber's moisture content is stabilized to within 5 to 25% by weight of the fiber, and preferably to within 10 to 20% by weight of the fiber. The control of moisture content in the Oasis fiber may provide the necessary anti-static and surface tension characteristics for subsequent operations. The two fibers are then mixed thoroughly before being laid down by a dry-laid process. Such procedure, where only the crimped fibers are opened before mixing with the non-crimped fibers, is a departure from the industrially accepted procedure of mixing both fibers before opening. In the present example, however, the opening of the crimped Kuralon fibers renders them more effective in mixing with the non-crimped Oasis fibers, thus providing much more contact areas for building up the frictional or cohesive strength of the fiber mass in the laying down process. A light weight Reemay™ Polyester spunbond or equivalent nonwoven fabric may be used as a carrier for the laid down fiber mass to prevent any fiber breakage before the bonding process. Mechanical bonding by means of needle-punching is used to bond the nonwoven fabric to achieve the required strength characteristics. Such needle-punching employs preferably 20 to 60 gage closed barb needles at 50 to 100 strokes per square centimeter. The type and gage of needles, their penetration depth and the needling density may be optimized for different weight nonwovens for the desired strength characteristics. The Reemay spunbond may be removed after the nonwoven fabric has been needle-punched. Such fabric with a weight of 50 grams per square meter, and preferably from 200 to 2000 grams per square meter, has been used in the manufacturing of chemical-mechanical planarization pads for semiconductor manufacture with superior performance.

Another non-limiting example employs exactly the same fiber mix and process for making the nonwoven fabric, with the exception that the diameter of the Oasis fiber employed is relatively larger at 20 dtex. The resulting pad product may be useful in another chemical-mechanical planarization application where the size of the soluble fiber is advantageous to performance.

It may be appreciated that in some embodiments, the steps noted in the above examples may occur in a given order. For example, mixing and opening all fiber types together as commonly practiced by the nonwovens industry, may lead to non-uniform mixing and fiber breakage when one of the fiber types is non-crimped, moisture sensitive and/or brittle. Such uncrimped fiber may break due to the mechanical fiber mixing and opening actions, resulting in a weak and non-uniform nonwoven fabric.

As mentioned, one of the applications of the present invention is in the manufacturing of chemical-mechanical planarization (CMP) pads. For example, in one preferred embodiment, a fabric including 5% to 95% by weight of soluble, non-crimped fiber, such as the above mentioned Oasis polyacrylate fiber, and 2% to 98% by weight of another soluble or insoluble crimped fiber. The fabric may be formed via the dry-laid process and needle bonded. The fabric may then be immersed in a polymer precursor, such as a polyurethane pre-polymer mixed with a curative, and the polymer pre-cursor may be solidified to form a solid sheet or pad from which the planarization pad may be formed. A post-curing process at elevated temperature may complete the curing of the polyurethane. The nonwoven fabric embedded in the cured polyurethane may be subsequently removed by dissolution in deionized water leaving an intricate network of pores and empty tunnels which are found to be highly effective for chemical-mechanical planarization.

Consistent with the above, it may be appreciated that the pores that are formed may now be conveniently regulated with respect to both pore size distribution and the size of the pores that may be formed for a given polishing pad application. That is, it can be appreciated that the fibers upon dissolution will provide openings in the pad, and a corresponding porosity. Therefore, the fiber length and diameter, as well as fiber shaped (crimped versus non-crimped), concentration of fibers in a given pad, and fiber entanglement and orientation may now all be regulated to provide a desired porosity distribution in the pad, once the fibers are dissolved. This in turn may effect polishing as the porosity that is formed may provide for relatively more or relatively less interaction with a slurry and the abrasive particles within a slurry. For example, in the case of non-crimped fibers that are soluble, the pores that may be formed may have a length of 0.1 cm to 127 cm and a diameter of 1.0 μm to 1000 μm, preferably 5.0 μm to 50.0 μm in a generally cylindrical type configuration, which configuration is not generally available with a crimped fiber configuration, due to the crimping of the fiber. In addition, the void content that is produced in the pad may be up to 90.0% by volume of the pad, preferably in the range of 30.0% by volume to 60.0% by volume. Such void content may be regulated at a level of +/−1.0%. The void content so expressed is a relationship of the pad void volume to the total volume of a given pad being evaluated. In addition, one may selectively place the soluble fibers in a particular region of the pad (e.g., in that portion of the pad that is exposed to the polishing slurry). In this manner, one portion of the pad may be continuously dissolving and forming voids for a given polishing protocol, and the other portion of the pad, affixed to the polishing tool, will remain unchanged.

In yet another example, a pad may be formed by mixing a water soluble non-crimped fiber with insoluble binder or bicomponent fiber in the same fashion as mentioned above. A nonwoven fabric may then be formed by the dry-laid or air-laid process, producing a homogenous or non-homogenous fiber mat. The nonwoven fabric may then be bonded by thermal, mechanical or chemical bonding techniques producing the fabric. Heat and pressure may then be applied to the fabric forming the fabric into a solid polishing pad with or without the aforementioned polyurethane precursor. As in previous examples, the soluble fibers may be dissolved and removed from the pad resulting in pores and/or empty tunnels beneficial for chemical-mechanical planarization.

Figure 2:
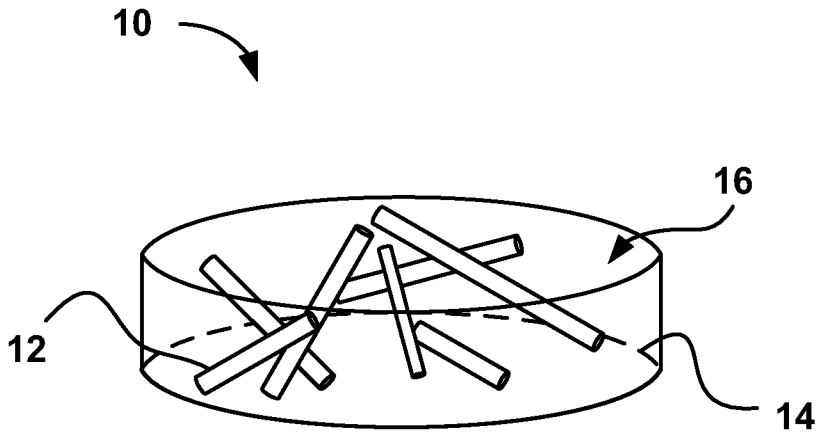
FIG. 2 illustrates a polishing pad including a network of soluble and non-crimped fibers.

The polishing pad may therefore include a number of soluble fibers (crimped or uncrimped) dispersed through the body of the polishing pad. Illustrated in FIG. 2 is an example of a polishing pad 10, including a network of soluble (in aqueous solution) of non-crimpled fibers 12, which pad may therefore specifically include 2% by weight to 98% by weight of the non-crimped fibers and which may therefore include, as a remainder portion, a portion of non-crimped fibers (soluble and/or insoluble). The soluble fibers may be embedded in a polymer matrix 14 or the soluble fibers, alone or in combination with other non-soluble fibers, may make up the entirety of the polishing pad. As a surface 16 of the pad is worn away, either through polishing or machining, the soluble fibers 12 may be exposed. If an aqueous solution is present, the soluble fibers may dissolve, leaving grooves defined in the pad.

The polishing pad itself may include up to 100% by weight soluble fibers (crimped or uncrimped) including all values and increments in the range of 2% to 100% by weight. For example, the polishing pad may contain 75% by weight of non-crimped soluble fibers and 25% by weight of crimped soluble fibers. Moreover, the polishing pad may contain, as noted, 100% by weight soluble and non-crimped fibers. Accordingly, the use of soluble fibers herein may be selected to provide an underlying distribution of crimped and non-crimped fibers, as noted through-out this disclosure.

Figure 3:
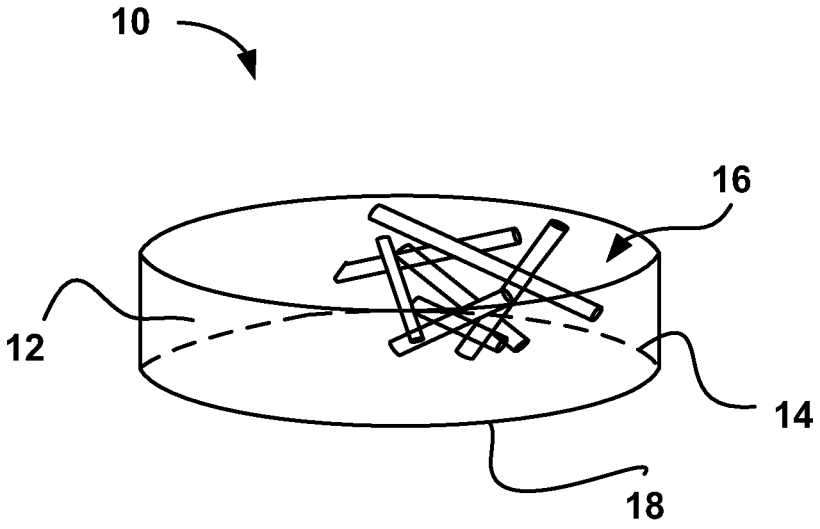
FIG. 3 illustrates a polishing pad where soluble non-crimped fibers are advantageously positioned in specific portions of the pad.

The soluble fibers may also be distributed through the entirety of the pad in a relatively uniform manner, i.e., the weight portion of soluble fibers in a given volume may be relatively similar to weight portions of soluble fibers in other portions of the polishing pad. As illustrated in FIG. 3, the soluble fiber 12 may also be distributed in specific portions of the pad 10, such that relatively greater concentrations of soluble fiber may be positioned near a given surface of the polishing pad 16 (e.g. within 0.1 cm of the pad surface) whereas another given surface 18 of the polishing pad may include little to no soluble fiber (e.g. no soluble fibers within 1.0 cm of the surface 18). As may be appreciated, relatively greater concentrations of the soluble fibers may be available in other portions of the planarization pad as well, such as near the exterior surface or interior surface of the polishing pad, or with various domains within the polishing pad volume.

Again, as noted, the soluble fibers in the formed polishing pads may dissolve upon contact with an aqueous based polishing solution (e.g. containing at least about 10% water) or water. A polishing solution may include, for example, abrasive particles dispersed in the polishing solution.

Figure 4:
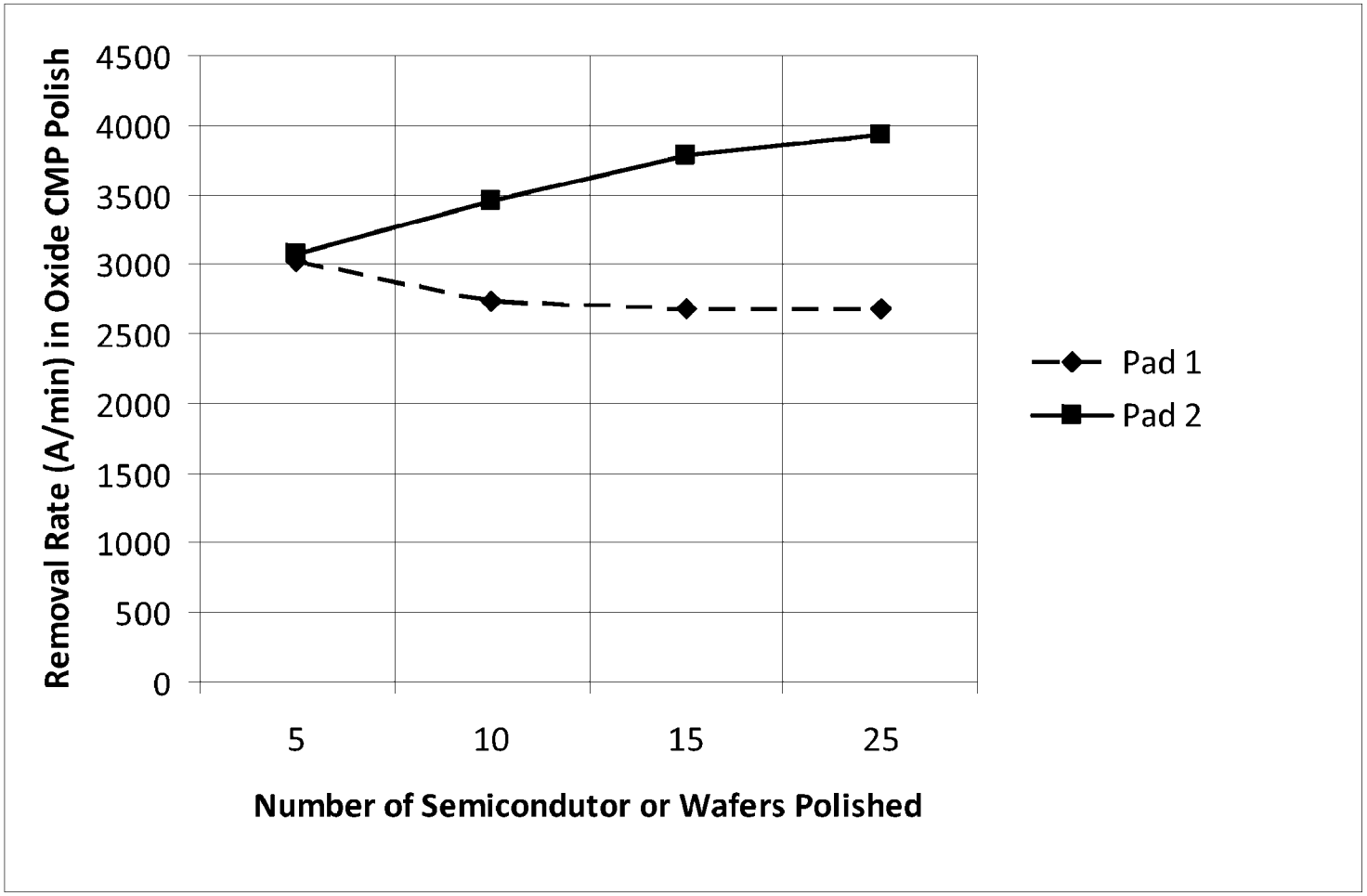
FIG. 4 illustrates the removal rate in angstroms per minute (A/min) versus the number of semiconductor wafers polished, for Pad 1 (crimped fibers) and Pad 2 (uncrimped fibers).

Attention is next directed to FIG. 4, which illustrates a plot of the removal rate in angstroms/minute (A/min) of pads (Y-axis) versus the number of semiconductor wafers polished, containing in one case, crimped soluble fibers (polyvinyl alcohol based) and in another case, uncrimped fibers (polyvinyl alcohol based). More specifically, Pad 1 includes crimped soluble fibers in a polyurethane matrix, where the crimped fibers are present at a level of about 25% by weight. Pad 2 includes non-crimped soluble fibers, also in a polyurethane matrix, and also at a level of about 25% by weight. As can be seen, unexpectedly, the removal rate of Pad 2 was generally higher, thereby confirming the improvement in polishing for the uncrimped fibers noted herein. In FIG. 4, the slurry as indicated is an oxide CMP polishing slurry, which is an aqueous based slurry.

Figure 5:
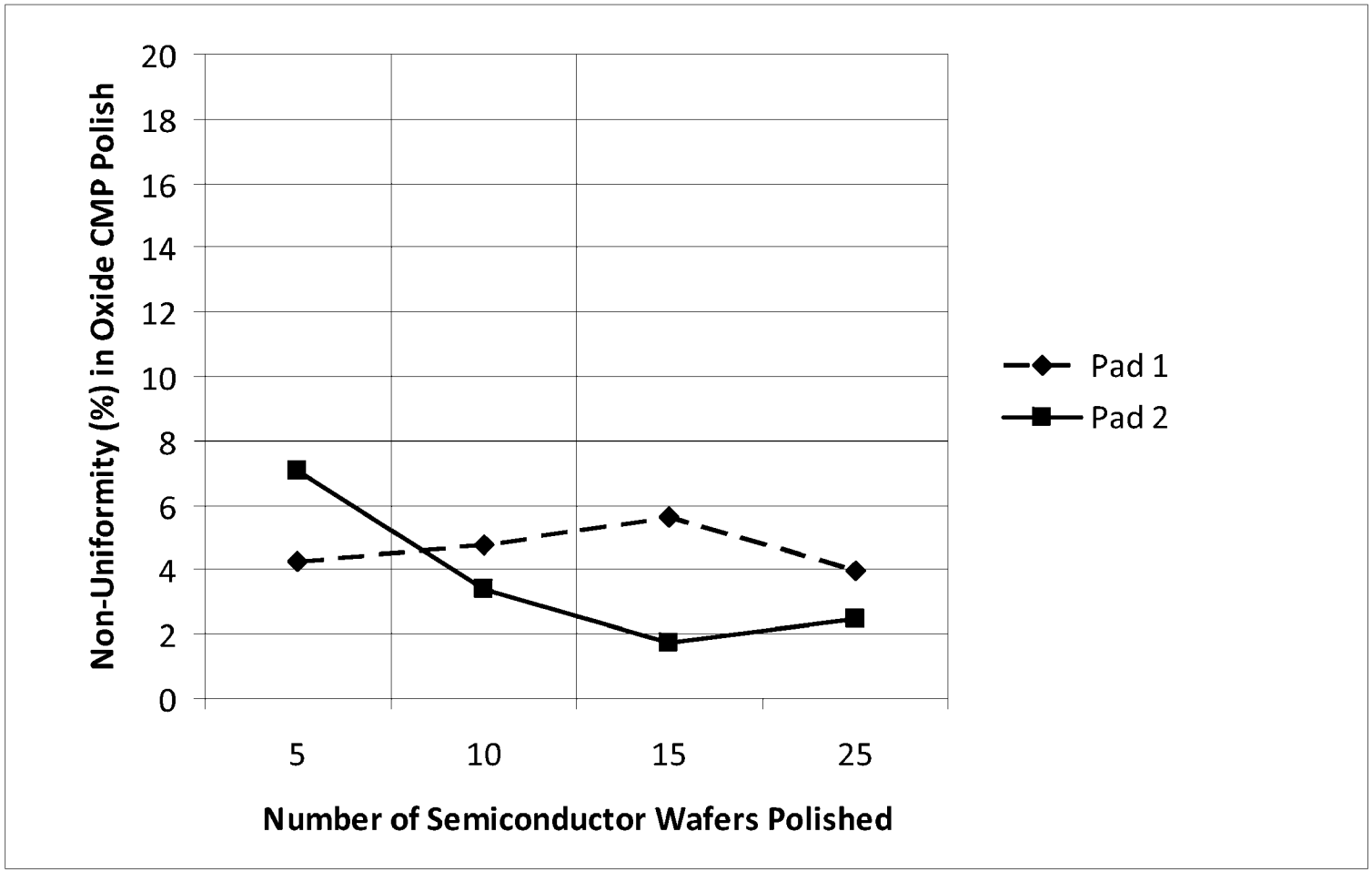
FIG. 5 illustrates the non-uniformity (%) in polishing versus the number of semiconductor wafers polished for Pad 1 (soluble crimped fibers) and Pad 2 (uncrimped soluble fibers).

Attention is next directed to FIG. 5, which illustrates a plot of non-uniformity of the polished substrate (Y-axis) versus the number of semiconductor wafers polished. As may be appreciated, the target is to provide uniformity in thickness in the wafers from the polishing operation. Pad 1 again includes crimped soluble fibers (polyvinyl alcohol based) in a polyurethane matrix, where the crimped fibers are present at a level of about 25% by weight. Pad 2 again includes non-crimped soluble fibers (polyvinyl alcohol based) also in a polyurethane matrix, and also at a level of about 25% by weight. As can be seen, once the polishing operation has been applied to about 10 wafers, the uncrimped fibers demonstrated improved uniformity in the thickness of the polished wafer, again confirming the improvement in polishing noted herein for uncrimped fiber based CMP pads. In FIG. 5 the slurry as indicated is an oxide CMP polishing slurry, which is an aqueous based slurry.

While a preferred embodiment of the present invention has been described, it should be understood that various changes, adaptations and modifications can be made therein without departing from the spirit of the invention and the scope of the appended claims. The scope of the invention should, therefore, be determined not with reference to the above description, but instead should be determined with reference to the appended claims along with their full scope of equivalents. Furthermore, it should be understood that the appended claims do not necessarily comprise the broadest scope of the invention which the Applicant is entitled to claim, or the only manner(s) in which the invention may be claimed, or that all recited features are necessary.

The invention claimed is:

1. A polishing pad for chemical-mechanical planarization of semiconductors comprising:

a nonwoven fabric comprising a mat containing synthetic fibers, wherein said fibers are non-crimped fibers wherein said non-crimped fibers are present in an amount of 1.0% by weight to 98.0% by weight in said mat and wherein said non-crimped fibers have a length of 0.1 cm to 127 cm and a diameter of 1.0 to 1000 micrometers;

wherein said non-crimped fibers are at least partially soluble in aqueous solution; and wherein the at least partially soluble fibers are embedded in a polymer matrix worn away during use of the pad.

2. The polishing pad of claim 1, wherein said non-crimped fibers comprise two fibers, one of which has a first degree of solubility (S1) in a slurry, one of which has a second degree of solubility (S2) in a slurry, wherein $S_1$ is less than $S_2$.

3. The polishing pad of claim 1, wherein said non-crimped fibers are mechanically entangled.

4. The polishing pad of claim 1, wherein said non-crimped fibers are thermally or chemically bonded to one another.

5. The polishing pad of claim 1, wherein said non-crimped fibers are present in said mat at a level of 50.0% by weight to 90% by weight and said mat includes crimped fibers present at a level of 10% by weight to 50% by weight.

6. The polishing pad of claim 1, wherein said non-crimped fibers have a diameter of 5.0 micrometers to 50.0 micrometers.

7. A polishing pad for chemical mechanical planarization of semiconductors comprising:

a nonwoven fabric comprising a mat containing synthetic fibers, wherein said fibers are non-crimped fibers wherein said non-crimped fibers are present in an amount of 1.0% by weight to 98.0% by weight in said mat and wherein said non-crimped fibers have a length of 0.1 cm to 127 cm and a diameter of 1.0 to 1000 micrometers, and wherein said non-crimped fibers are at least partially soluble in an aqueous solution;

wherein said non-crimped at least partially soluble fibers comprises two fibers, one of which has a first degree of solubility in said aqueous solution (S1), one of which has a second degree of solubility in said aqueous solution (S2), wherein $S_1$ is less than $S_2$; and wherein the at least partially soluble fibers are embedded in a polymer matrix worn away during use of the pad.

8. The polishing pad of claim 7, wherein said pad includes non-soluble fiber, wherein said non-soluble fiber comprises crimped fiber and/or non-crimped fiber.

9. The polishing pad of claim 7, wherein said non-crimped at least partially soluble fibers are present at a level of 50% by weight to 98% by weight.

10. The polishing pad of claim 7, wherein said non-crimped at least partially soluble fibers are mechanically entangled.

11. The polishing pad of claim 7, wherein said non-crimped at least partially soluble fibers are thermally or chemically bonded to one another.

12. The polishing pad of claim 7, wherein said non-crimped at least partially soluble fibers are present in said mat at a level of 50.0% by weight to 90% by weight and said mat includes crimped fibers present at a level of 10% by weight to 50% by weight.

13. The polishing pad of claim 7, wherein said non-crimped at least partially soluble fibers have a diameter of 5.0 micrometers to 50.0 micrometers.

14. The polishing pad of claim 7, wherein said non-crimped at least partially soluble fibers are selectively positioned in said mat, wherein said position comprises that portion of the polishing pad that is configured to contact a polishing slurry.

15. A method for chemical-mechanical planarization of semiconductors comprising:

supplying a nonwoven fabric comprising a mat containing synthetic fibers, wherein said fibers are non-crimped fibers wherein said non-crimped fibers are present in an amount of 1.0% by weight to 98.0% by weight in said mat and wherein said non-crimped fibers have a length of 0.1 cm to 127 cm and a diameter of 1.0 to 1000 micrometers, wherein said non-crimped fibers are at least partially soluble in aqueous solution;

embedding the at least partially soluble fibers in a polymer matrix to provide a polishing pad, wherein the polymer matrix is worn away during use of the pad; and polishing a semiconductor with said polishing pad.

16. The method of claim 15, further including:

supplying a slurry for polishing wherein said slurry is in liquid form; and positioning said fabric containing said fibers including said non-crimped fibers on a polishing tool for polishing a semiconductor.

17. The method of claim 15, wherein said non-crimped fibers are present in an amount of 50.0% by weight to 90.0% by weight in said non-woven mat.

18. The method of claim 15, wherein said non-crimped fibers have a diameter of 5.0 to 50.0 micrometers.

19. The method of claim 15, wherein said non-crimped fibers comprise two fibers, one of which has a first degree of solubility (S1) in said slurry, one of which has a second degree of solubility (S2) in said slurry, wherein $S_1$ is less than $S_2$.

20. The method of claim 15, wherein said non-crimped fibers are mechanically entangled.

21. The method of claim 15, wherein said non-crimped fibers are thermally or chemically bonded to one another.

22. The method of claim 15, wherein said non-crimped fibers are present in said mat at a level of 50.0% by weight to 90% by weight and said mat includes crimped fibers present at a level of 10% by weight to 50% by weight.

* * * * *